US006736736B2

(12) United States Patent
Binette

(10) Patent No.: US 6,736,736 B2
(45) Date of Patent: May 18, 2004

(54) GOLF BALL HAVING IMPROVED HEAT RESISTANCE

(75) Inventor: Mark L. Binette, Ludlow, MA (US)

(73) Assignee: Callaway Golf Company, Carlsbad, CA (US)

( * ) Notice: Subject to any disclaimer, the term of this patent is extended or adjusted under 35 U.S.C. 154(b) by 13 days.

(21) Appl. No.: 10/083,739

(22) Filed: Feb. 26, 2002

(65) Prior Publication Data

US 2002/0147059 A1 Oct. 10, 2002

Related U.S. Application Data

(63) Continuation-in-part of application No. 09/235,252, filed on Jan. 22, 1999.

(51) Int. Cl.[7] ..... A63B 37/12
(52) U.S. Cl. ..... 473/374; 473/378
(58) Field of Search ..... 473/378, 377, 473/374, 376

(56) References Cited

U.S. PATENT DOCUMENTS

| | | | | |
|---|---|---|---|---|
| 4,431,193 | A | | 2/1984 | Nesbitt |
| 4,679,795 | A | | 7/1987 | Melvin et al. |
| 4,683,257 | A | | 7/1987 | Kakiuchi et al. |
| 4,838,556 | A | | 6/1989 | Sullivan |
| 4,844,471 | A | | 7/1989 | Terence et al. |
| 4,852,884 | A | | 8/1989 | Sullivan |
| 4,884,814 | A | | 12/1989 | Sullivan |
| 4,911,451 | A | | 3/1990 | Sullivan et al. |
| 4,919,434 | A | | 4/1990 | Saito |
| 5,452,898 | A | | 9/1995 | Yamagishi et al. |
| 5,538,794 | A | | 7/1996 | Cadorniga et al. |
| 5,580,927 | A | * | 12/1996 | Chou et al. ..... 525/201 |
| 5,688,869 | A | * | 11/1997 | Sullivan ..... 525/196 |
| 5,702,312 | A | | 12/1997 | Horiuchi et al. |
| 5,816,943 | A | | 10/1998 | Masutani et al. |
| 5,857,925 | A | | 1/1999 | Sullivan et al. |
| 5,888,151 | A | * | 3/1999 | Hayashi ..... 473/363 |
| 5,916,950 | A | * | 6/1999 | Obuchi et al. ..... 524/492 |
| 5,965,669 | A | * | 10/1999 | Cavallaro et al. ..... 525/221 |
| 5,973,046 | A | * | 10/1999 | Chen et al. ..... 524/300 |
| 6,284,840 | B1 | * | 9/2001 | Rajagopalan et al. ..... 525/92 A |
| 6,450,901 | B1 | * | 9/2002 | Binette et al. ..... 473/378 |

FOREIGN PATENT DOCUMENTS

| | | |
|---|---|---|
| GB | 2309971 | 8/1997 |

OTHER PUBLICATIONS

*Golf Tips Magazine*, Oct. 2000 issue, p. 14.

* cited by examiner

*Primary Examiner*—Raeann Gorden

(57) ABSTRACT

The present invention is directed to a golf ball exhibiting improved heat resistance features while maintaining desired playability features. Particularly, the present invention is directed to a golf ball having a core and a cover disposed about the core, the cover being less than 20 parts by weight of at least one hard ionomer copolymer having a Vicat softening temperature of at least about 74° C. and at least 80 parts by weight of at least one soft ionomer. Preferably, the soft ionomer exhibits a Vicat softening temperature of less than about 50° C. Preferably, the at least one soft ionomer is a terpolymer.

18 Claims, 1 Drawing Sheet

GOLF BALL HAVING IMPROVED HEAT RESISTANCE

CROSS REFERENCE TO RELATED APPLICATIONS

The present application is a continuation-in-part of U.S. patent application Ser. No. 09/235,252, filed Jan. 22, 1999.

FIELD OF THE INVENTION

This invention relates generally to golf balls, and specifically to ionomer covered golf balls (more preferably, soft ionomer covered golf balls) having improved heat resistance. These golf balls exhibit improved melt resistance and heat stability when subject to high temperatures, i.e. 50° C. or more. Such high temperatures can be present in the trunks and/or interiors of automobiles, shipping containers, truck trailers, warehouses, etc., in warm climates and/or on hot summer days. The golf balls of the invention exhibit improved heat stability without sacrificing properties such as distance, durability and/or playability.

BACKGROUND OF THE INVENTION

Before the development of ionomers, balata was the preferred material of formulations for golf ball covers. Polyethylene was also proposed for use as a golf ball cover material, but was generally deemed highly inferior to balata in imparting playability and durability characteristics to the ball due to its brittleness and high hardness, and thus never became a commercially successful golf ball cover material.

Balata golf ball covers have now been replaced to a great extent by ionomeric cover materials. As a result of their toughness, durability, and flight characteristics, various ionomeric resins sold by E.I. DuPont deNemours & Company (see U.S. Pat. No. 4,884,814) under the trademark SURLYN® and by the ExxonMobil Corporation (see U.S. Pat. No. 4,911,451) under the trademarks ESCOR® and IOTEK®, have become the materials of choice for the construction of golf ball covers over the traditional "balata" (trans polyisoprene, natural or synthetic) rubbers. The softer balata covers, although exhibiting enhanced playability properties, lack the overall durability necessary for repetitive play.

Ionomeric resins are generally ionic copolymers or terpolymers of an olefin such as ethylene and a metal salt of an unsaturated carboxylic acid, such as acrylic acid, methacrylic acid, or maleic acid. Optionally, an acrylate can also be present. Metal ions, such as sodium or zinc, are used to neutralize some portion of the acidic groups in the copolymer resulting in a thermoplastic elastomer exhibiting enhanced properties, such as improved durability, for golf ball cover construction over balata.

In this regard, the metal ions serve as crosslinking agents, as they are ionically bonded to carboxylic acid groups in adjacent copolymer chains. However, instead of having a thermally irreversible covalent bonding crosslinking, ionomers have a thermolabile crosslinking, where metal ions become part of the chemical structure of the ionomer upon crosslinking so that these crosslinks are reversible. Consequently, ionomers are subject to distortion or degradation at high temperatures.

Furthermore, the advantages gained through the use of ionomer resins in golf ball cover formulations in increased durability have been offset to some degree by the decrease in playability. Although ionomeric resins are very durable, they tend to be very hard when utilized for golf ball cover construction, and thus lack the degree of softness required to impart the spin necessary to control the ball in flight.

As a result, while there are currently numerous commercial grades of ionomers available with a wide range of properties that vary according to the type and amount of metal cations, molecular weight, composition of the base resin (i.e. relative content of ethylene and methacrylic and/or acrylic acid groups) and additive ingredients such as reinforcements, a great deal of research continues in order to develop golf ball cover compositions exhibiting not only the improved impact resistance and carrying distance properties produced by the "hard" ionomeric resins, but also the playability (i.e. "spin") characteristics previously associated with the "soft" balata covers, properties which are still desired by the more skilled golfer.

In various attempts to produce such an ideal golf ball, the golfing industry has blended hard ionomeric resins with a number of softer polymeric materials, such as softer polyurethanes. However, the blends of hard ionomer resins with softer polymeric materials have generally been unsatisfactory, as these balls exhibit numerous processing problems. In addition, the balls produced by such a combination usually lack the distance desired by a golf ball.

In addition, various "hard-soft ionomeric blends", i.e. mixtures of ionomer resins which are significantly different in hardness and/or flexural modulus, have been attempted. However, until the development of the specific blend combination set forth in U.S. Pat. No. 4,884,814, directed to low modulus golf ball cover compositions, these balls were not particularly commercially viable. In this regard, although the balls produced using the hard-soft ionomer blends exhibited enhanced playability characteristics, they lacked the durability needed for continuous play.

Moreover, while there are numerous advantages to the use of ionomers in making golf ball covers, one drawback of conventional golf balls with ionomeric covers are that the covers are prone to softening at temperatures of approximately 50° C. or above. As a result, the ionomeric covers (and in particular, soft ionomeric covers) may lose their dimple pattern or develop flat spots if exposed to high temperatures.

Accordingly, it would be useful to develop a golf ball with an ionomeric cover which is highly resistant to high temperature distortion or degradation without sacrificing the properties of distance, durability and/or playability.

Furthermore, it would be useful to improve the heat resistance of soft ionomeric golf ball covers without substantially hardening the covers. This would result in the production of a soft ionomer covered golf ball having the distance, durability and/or playability characteristics desired while also being resistant to degradation at high temperatures.

SUMMARY OF THE INVENTION

The present invention relates to new and improved golf balls which overcome the above referenced problems and others. In this regard, the present invention is directed to golf balls having improved heat and/or melt resistance. This enables the golf balls to withstand prolonged exposure to heat during use or storage.

In one aspect, the present invention is directed to a golf ball comprising a core and a cover disposed about the core. The cover comprises less than about 20 parts by weight of at least one hard ionomer copolymer and at least about 80 parts by weight of at least one soft ionomer. The at least one hard ionomer exhibits a Vicat softening temperature of at least about 74° C. The at least one soft ionomer exhibits a Vicat softening temperature of less than about 50° C.

In another aspect, the present invention is directed to a golf ball comprising a core and a cover disposed about the core. The cover comprises less than about 20 parts by weight of at least one hard ionomer copolymer and at least about 80 parts by weight of a blend of two soft ionomer terpolymers. The at least one hard ionomer copolymer exhibits a Vicat softening temperature of at least about 74° C. The blend of two soft ionomer terpolymers exhibit a Vicat softening temperature of less than 50° C.

In a further aspect, the present invention is directed to a golf ball comprising a core and a cover disposed about the core. The cover comprises from about 1 to about 50 parts by weight of at least one non-ionomeric terpolymer and from about 99 to about 50 parts by weight of at least one soft terpolymer. The non-ionomeric terpolymer exhibits a Vicat softening temperature of at least 74° C. The at least one soft ionomer terpolymer exhibits a Vicat softening temperature of less than 50° C.

Another object of the invention is to provide a method for improving the heat and/or melt resistance of a golf ball cover. The invention is directed to any type of ionomer covered golf ball including wound, two-piece, three-piece and multi-layered golf balls.

Yet another object of the invention is to provide a golf ball with a soft ionomer cover which is well-suited for repetitive play and exhibits improved heat and/or melt resistance when subject to high temperatures, i.e. 50° C. or more.

Another object of the invention is to provide a golf ball with a very soft ionomeric cover having enhanced heat stability and/or improved heat and melt resistance. These golf balls also exhibit the feel and playability characteristics that highly-skilled golfers prefer. This enables the soft covered golf balls to exhibit enhanced dimple retention during prolonged exposure to high temperatures.

Other objects will be in part obvious and in part pointed out in more detail hereinafter.

In accordance with the present invention, there is provided a golf ball comprising a core and a dimpled cover having a Shore D hardness of 63 or less as measured on a non-dimpled portion of the cover, the dimples maintaining their shape when the cover is subjected to prolonged heat exposure at 160–180° F. (71–82° C.) for at least one hour.

The core component of the invention can consist of a solid or wound core. Additionally, the core can consist of one or more layers. Similarly, the cover component of the golf ball can consist of one or more layers. However, the outer layer of the golf ball is comprised of an ionomer based material.

More particularly, the outer cover is a blend of one or more ionomer copolymers and/or terpolymers and one or more ionomers having a high Vicat softening temperature. Preferably, the high Vicat softening temperature ionomer also has a high melt temperature. More preferably, the difference between the high melt temperature and the Vicat softening temperature of the high melt ionomer is minimized. It has been found that such high melt ionomers act as good heat stability modifiers for ionomer covers, and in particular, for soft ionomer covered golf balls.

Along these lines, the Vicat softening temperature of the high melt ionomer incorporated into the present invention is 74° C. or more, preferably 80° C. or more, and most preferably, 84° C. or more. The melt temperature of the high melt ionomer is 96° C. or more, preferably 98° C. or more, and most preferably, 100° C. or more. Furthermore, the high melt ionomer utilized in the invention exhibits a difference in melt temperature and Vicat temperature of 25° C. or less, more preferably 19° C. or less, most preferably 17° C. or less.

Additionally, the high melt ionomer of the present invention can also be utilized to formulate an inner cover layer or mantle of a multi-layer golf ball. Accordingly, one or more of the ionomer layers of a multi-layer golf ball can exhibit high heat stability.

The dimpled cover golf ball of the present invention can have a Shore D hardness cover of 63 or less, preferably 55 or less, and most preferably 50 or less. The dimpled cover is formed from a cover material which comprises at least 80 parts by weight of copolymer or terpolymer ionomer (preferably 80–97, most preferably 91–94) and 3–20 parts by weight of high melt ionomer (preferably 3–10, most preferably 6–9).

These and other objects and features of the invention will be apparent from the following descriptions and from the claims.

BRIEF DESCRIPTION OF THE DRAWINGS

The following is a brief description of the drawings which are presented for the purposes of illustrating the invention and not for the purposes of limiting the same.

DETAILED DESCRIPTION OF THE INVENTION

The golf balls of the present invention are surprisingly superior in their heat resistance to conventional golf balls which contain similar quantities of ionomer and have similar hardnesses. Furthermore, the golf balls of the invention are comparable in heat resistance to golf balls having non-ionomeric compositions, such as polyurethanes, with similar properties of compression, coefficient of restitution (C.O.R.) and hardness.

Generally, any noticeable loss in dimple depth of a golf ball due to heat exposure is unacceptable. The present invention is directed to the prevention of such a loss. Loss of dimple depth is particularly true with golf balls having a relatively soft outer cover layer. Such an outer cover layer has a plaque Shore D hardness (ASTM® D-2240) in the range of 30–63, more preferably 35–55, and most preferably 40–50. In this regard, It has been found that the heat resistance of such an outer cover can be increased through the use of the present invention. This enables the soft covered golf balls to withstand prolonged exposure to heat during use or storage.

Figure 1:
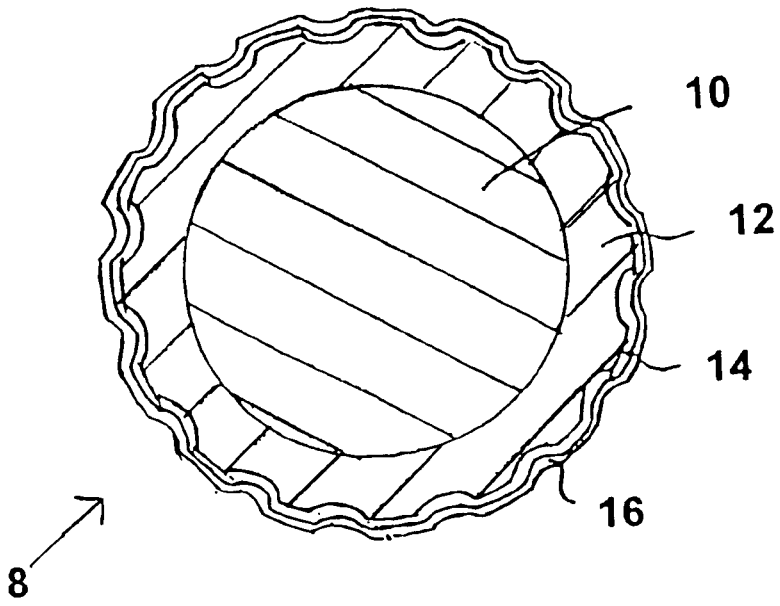
FIG. 1 shows a golf ball according to the present invention.

Referring now to the drawings, and in particular to FIG. 1, a golf ball according to the present invention is shown and is designated as 8. The ball has a core 10, which is solid, or is formed from any other suitable type of core material. An ionomeric cover 12 surrounds the core 10 to form an unfinished two piece golf ball. A thin primer coat 14 is applied to the outer surface of cover 12. A thin top coat 16 surrounds the primer coat 14 to form a finished golf ball. The thicknesses of primer coat 14 and top coat 16 are exaggerated for illustrative purposes.

The ionomeric cover 12 comprises a blend of one or more soft or hard ionomer copolymers and/or terpolymers and one or more ionomers having a high Vicat softening temperature.

Preferably the high Vicat softening temperature ionomer also has a high melt temperature. Such ionomers are referred to herein as "high melt ionomers." Additionally, more optimal results have been found when the difference between the high melt temperature and the Vicat softening temperature of the high melt ionomer is minimized.

Particularly preferred soft and/or hard ionomers or ionomer blends utilized in the invention include ionic copolymers containing an olefin, an unsaturated carboxylic acid, and optionally, an acrylate. Such polymers typically, although not necessarily, have a Shore D hardness in the range of 20–60.

The present invention can include a blend of hard and soft ionomers. Preferably, the blend includes less than 20 parts by weight of a hard ionomer and at least 80 parts by weight of a soft ionomer.

The soft (low modulus) ionomers utilized to formulate the blends of the present invention may be generally characterized as being comprised of metal salts of a copolymer or terpolymer of an olefin having from about 2 to 8 carbon atoms, acrylic or methacrylic acid, and optionally an unsaturated monomer of the acrylate ester class having from 2 to 22 carbon atoms.

The soft (low modulus) ionomers have a hardness from about 20 to about 40 (preferably from about 30 to about 40) as measured on the Shore D scale and a flexural modulus from about 2,000 to about 10,000 psi (preferably from about 3,000 to 7,000 psi) as measured in accordance with ASTM® method D-790.

More particularly, it has been found that if one or more acrylic acid based soft ionomers are utilized with the specific high Vicat softening and/or high melt temperature ionomers described below (and in the combinations more clearly defined below and demonstrated in the Examples), improvements in processability and clarity are seen. In addition, the overall combinations, when utilized for golf ball construction, produce golf balls exhibiting enhanced heat stability and having higher coefficient of restitution values (i.e. longer distance) at equal or softer hardness values than golf balls produced by other known hard-soft ionomer blends.

When the ethylene-acrylic acid based soft ionomer resins IOTEK® 7520 and IOTEK® 7510 are optionally combined with known hard ionomers (such as those indicated below), the combination produces higher C.O.R.s at equal or softer hardness, higher melt flow as well as improved heat resistance.

Collected information indicates that IOTEK® 7520 resins have Shore D hardnesses of about 32–36 (per ASTM® D-2240), melt flow indexes of 3±0.5 g/10 min (at 190° C. per ASTM® D-1288), a flexural modulus of about 2500–3500 psi (per ASTM® D-790). Furthermore, testing by an independent testing laboratory by pyrolysis mass spectrometry indicates that the IOTEK® 7520 resins are generally zinc salts of a terpolymer of ethylene, acrylic acid, and methyl acrylate.

The acrylic acid based soft ionomer, IOTEK® 7510, is also effective when combined with the ionomers exhibiting high melt temperatures and/or high Vicat softening temperatures in producing golf ball covers exhibiting improved heat resistance and higher C.O.R. values at equal or softer hardness than those produced by known hard-soft ionomer blends.

In addition, IOTEK® 7510, when compared to IOTEK® 7520, produces slightly higher C.O.R. values at equal softness/hardness due to the IOTEK® 7510's higher hardness and neutralization. Similarly, IOTEK® 7510 produces better release properties (from the mold cavities) due to its slightly higher stiffness and lower flow rate than IOTEK® 7520. This is important in production where the soft covered balls tend to have lower yields caused by sticking in the molds and subsequent punched pin marks from the knockouts.

According to ExxonMobil, IOTEK® 7510 is of similar chemical composition as IOTEK® 7520 (i.e. a zinc salt of a terpolymer of ethylene, acrylic acid, and methyl acrylate) but is more highly neutralized. Based upon FTIR analysis, IOTEK® 7520 is estimated to be about 30–40 wt.-% neutralized and IOTEK® 7510 is estimated to be about 40–60 wt.-% neutralized. The typical properties of IOTEK® 7510 in comparison of those of IOTEK® 7520 are set forth below in TABLE 1.

TABLE 1

Physical Properties of IOTEK ® 7510 in Comparison to IOTEK ® 7520

| PROPERTY | IOTEK ® 7520 | IOTEK ® 7510 |
|---|---|---|
| MI, g/10 min | 2.0 | 0.8 |
| Density, g/cc | 0.96 | 0.97 |
| Melting Point, ° F. | 151 | 149 |
| Vicat Softening Point, ° F. | 108 | 109 |
| Flex Modulus, psi | 3800 | 5300 |
| Tensile Strength, psi | 1450 | 1750 |
| Elongation, % | 760 | 690 |
| Hardness, Shore D | 32 | 35 |

In addition to the ethylene-acrylic acid based soft ionomers (i.e. the IOTEK® 7520 and the IOTEK® 7510 resins) set forth above, other known soft ionomers can be utilized in the present invention. For example, the soft SURLYN® ionomers (i.e. the SURLYN® 8265 and 8269 resins) can also be utilized. These are of the poly(ethylene-methacrylic acid-butyl acrylate) type. The properties of these ionomers are set forth below in TABLE 2.

TABLE 2

| PROPERTY | SURLYN ® 8265/8120 | SURLYN ® 8269/8320 |
|---|---|---|
| Melt Index | 0.9 g/10 min. | 0.9 g/10 min. |
| Density | 0.94 | 0.94 |
| Cation | Na | Na |
| Melting Point | 81° C. | 72° C. |
| Crystallization Point | 51° C. | 38° C. |
| Vicat Softening Point | 51° C. | 48° C. |

Optionally, one or more hard ionomers may be included in the present invention. The hard (high modulus) ionomers suitable for use in the present invention include those ionomers having a hardness greater than 50 on the Shore D scale as measured in accordance with ASTM® method D-2240, and a flexural modulus from about 15,000 to about 70,000 psi as measured in accordance with ASTM® method D-790.

The hard ionomer resins utilized to produce the cover compositions are ionic copolymers which are the sodium, zinc, magnesium or lithium salts of the reaction product of an olefin having from 2 to 8 carbon atoms and an unsaturated monocarboxylic acid having from 3 to 8 carbon atoms. The carboxylic acid groups of the copolymer may be totally or partially (i.e. approximately 15–75 percent) neutralized.

Preferably, the hard ionomeric resins are copolymers of ethylene and either acrylic and/or methacrylic acid, with copolymers of ethylene and acrylic acid the most preferred. In addition, two or more types of hard ionomeric resins may be blended into the cover compositions in order to produce the desired properties of the resulting golf balls.

Examples of commercially available hard ionomeric resins which may be utilized in the present invention include the hard sodium ionic copolymer sold under the trademark SURLYN® 8940 and the hard zinc ionic copolymer sold under the trademark SURLYN® 9910. SURLYN® 8940 is a copolymer of ethylene with methacrylic acid with about 15 weight percent acid which is about 29% neutralized with sodium ions. This resin has an average melt flow index of about 2.8. SURLYN® 9910 is a copolymer of ethylene and methacrylic acid with about 15 weight percent acid which is about 58% neutralized with zinc ions. The average melt flow index of SURLYN® 9910 is about 0.7. The typical properties of particular SURLYN® ionomers are set forth in TABLE 3 below.

TABLE 3

Typical Properties of Commercially Available Hard SURLYN ® Resins Suitable for Use in the Present Invention

| | ASTM ® D | 8940 | 9910 | 8920 | 8528 | 9970 | 9730 |
|---|---|---|---|---|---|---|---|
| Cation Type | | Sodium | Zinc | Sodium | Sodium | Zinc | Zinc |
| Melt flow index, gms/10 min. | D-1238 | 2.8 | 0.7 | 0.9 | 1.3 | 14.0 | 1.6 |
| Specific Gravity, g/cm$^3$ | D-792 | 0.95 | 0.97 | 0.95 | 0.94 | 0.95 | 0.95 |
| Hardness, Shore D | D-2240 | 66 | 64 | 66 | 60 | 62 | 63 |
| Tensile Strength, (kpsi), Mpa | D-638 | (4.8) 33.1 | (3.6) 24.8 | (5.4) 37.2 | (4.2) 29.0 | (3.2) 22.0 | (4.1) 28.0 |
| Elongation, % | D-638 | 470 | 290 | 350 | 450 | 460 | 460 |
| Flexural Modulus, (kpsi), Mpa | D-790 | (51) 350 | (48) 330 | (55) 380 | (32) 220 | (28) 190 | (30) 210 |
| Tensile Impact (23° C.) KJ/m$_2$ (ft.-lbs./in$^2$) | D-18225 | 1020 (485) | 1020 (485) | 865 (410) | 1160 (550) | 760 (360) | 1240 (590) |
| Vicat Temperature, ° C. | D-1525 | 63 | 62 | 58 | 73 | 61 | 73 |

Other suitable hard SURLYN®ionomers include SURLYN®7940, SURLYN® 8020, SURLYN® 9020, and SURLYN® 9450. Each of the SURLYN® ionomers listed above are ethylene/methacrylic acid copolymers.

In addition, examples of the acrylic acid based hard ionomer resins suitable for use in the present invention sold under the IOTEK® trademark by the ExxonMobil Corporation include IOTEK® 4000 (formerly ESCOR® 4000), IOTEK® 4010, IOTEK® 8000 (formerly ESCOR® 900), IOTEK® 8020, and IOTEK® 8030. IOTEK® 4000, IOTEK® 4010, IOTEK® 8000, IOTEK® 8020, and IOTEK® 8030 are ethylene-acrylic acid copolymers.

Other IOTEK® ionomers for use in the present invention include IOTEK® 7010, IOTEK® 7020, IOTEK® 7030, and IOTEK® 3110. IOTEK® 7010, IOTEK® 7020, IOTEK® 7030, and IOTEK® 3110 are copolymers of the ethylene/acrylic acid neutralized by a metal ion.

The ionomers incorporated into the present invention to produce the improved heat stability are those ionomers which have a high Vicat softening temperature (ASTM® D 1525). The Vicat softening temperature of the high melt ionomer included in the invention has a Vicat softening temperature of at least least 74° C., preferably 80° C., and more preferably at least 84° C.

Preferably, the soft ionomers have a Vicat softening temperature of 50° C. or less. More preferably, the soft ionomers have a Vicat softening point of 45° C. or less.

Preferably the high melt ionomer included also has a high melt temperature (ASTM® D 3417). The melt temperature of the high melt ionomer included in the invention has a high melt temperature of 96° C. or more, preferably 98° C. or more and most preferably, 100° C. or more.

Additionally, it has also been found that the preferred high melt ionomer incorporated into the invention exhibits a difference between melt temperature and Vicat softening temperature of 25° C. or less, preferably 17° C. or less. It has been found that these high melt ionomers act as beneficial heat stability modifiers in ionomer cover compositions.

An example of such a high melt ionomer is SURLYN® 8549. According to DuPont, SURLYN® 8549 possesses the general characteristics disclosed in TABLE 4.

TABLE 4

| Properties of SURLYN ® 8549 | Units | Typical Value |
|---|---|---|
| Ion | | Na |
| Melt Flow Index | 190/2, 16 kg | 2, 3 |
| Melting Point | ° C. | 101 |
| Vicat Temperature | ° C. | 84 |
| Tensile Strength | MPa | 32 |
| Elongation at Break | % | 300 |
| Flex Modulus | MPa | 390 |
| Haze | % | 4 |
| Elmendorf Tear | g/25 $\mu$ | 34 |

Additionally, SURLYN® 8549 is distinguishable from other high melt ionomer resins as disclosed in TABLES 5 and 6.

TABLE 5

A. Physical Property Comparison

| | SURLYN ® 8549 | IOTEK ® 8610 | IOTEK ® 8000 | SURLYN ® 8940 | SURLYN ® 8527 | SURLYN ® 8660 |
|---|---|---|---|---|---|---|
| Melt index (g/10 min) | 2.3 | 1.3 | 0.8 | 2.8 | 1 | 10 |
| Melt temperature (° C.) | 100 | 86 | 83 | 94 | 93 | 95 |
| Vicat Softening temperature (° C.) | 84 | 57 | 54 | 63 | 73 | 71 |
| Tensile strength (MPa) | 32 | 34 | 33 | 33 | 29 | 23.4 |
| Elongation (%) | 300 | 420 | 370 | 470 | 450 | 470 |
| Flex modulus (MPa) | 390 | 290 | 320 | 350 | 220 | 230 |
| haze (%) | 4 | | 5 | 5 | 6 | 11 |
| Shore D | 61 | 58 | 60 | 65 | 60 | 62 |

TABLE 6

B. Differential Scanning Calorimeter Comparisons

| Grade | $T_c$ (° C.) | $T_m$ (° C.) | $T_m - T_c$ (° C.) |
|---|---|---|---|
| IOTEK ® 8000 | 43.8 | 85 | 41.2 |
| SURLYN ® 8660 | 60.7 | 96.9 | 35.9 |
| SURLYN ® 8940 | 54.6 | 91.8 | 37.2 |
| IOTEK ® 8000 | 42.9 | 84.9 | 42 |
| EX 1002 | 43.66 | 82.5 | 38.9 |
| AD 8549 | 64.7 | 99.4 | 34.7 |

In addition to the above, non-ionomeric materials can also be blended with the ionomers as long as an acceptable increase in heat resistance is obtained as a result of the inclusion of an ionomer having a high melt temperature and/or high Vicat softening temperature. Preferably, a blend of non-ionomeric material and ionomer includes from about 1 to about 50 parts by weight of a non-ionomeric material and from about 99 to about 50 by weight of an ionomer.

Non-limiting examples of materials to be blended with an ionomer include ethylene-ethyl acrylate, ethylene-methyl acrylate, ethylene-vinyl acetate, low density polyethylene, linear low density polyethylene, metallocene catalyzed polyolefins such as ENGAGE® polyolefins available from The Dow Chemical Co. and EXACT® polyolefins available from ExxonMobil, non-ionomeric acid copolymers such as PRIMACOR®, available from The Dow Chemical Co., and NUCREL®, available from E.I. DuPont deNemours & Co., and a variety of thermoplastic elastomers, including KRATON®, available from the Shell Oil Co., SANTOPRENE®, available from the Monsanto Co., and HYTREL®, available from DuPont, etc. Furthermore functionalized EPDM, such as maleated EPDM, nylon, and nylon-ionomer graft copolymers can be blended with the ionomer.

Particular non-ionomeric materials that can be blended with ionomers to increase heat resistance include terpolymers, such as polyethylene-methyl acrylate-acrylic acid terpolymers, including ESCOR® ATX (ExxonMobil Co.). Particularly, preferred commercially available materials include AT-320, AT-325, AT-310, and AT-350, and blends of these materials. The acid groups of these materials and blends are neutralized with one or more of potassium, calcium, manganese, nickel, etc. The degree of neutralization ranges from 10–100%. Generally, a higher degree of neutralization results in a harder and tougher cover material. The properties of non-limiting examples of commercially available un-neutralized acid terpolymers which can be used to form the golf ball outer cover layers of the invention are provided in TABLE 7 below.

TABLE 7

| Resin Properties | Test Based On | Units (SI) | AT-310 Typical Value | AT-320 Typical Value | AT-325 Typical Value |
|---|---|---|---|---|---|
| Melt Index | ExxonMobil Method | g/10 min | 6.0 | 5.0 | 20 |
| Density | ExxonMobil Method | g/cm³ | 0.943 | 0.953 | 0.950 |
| Acid Number | ExxonMobil Method | mg KOH/g polymer | 45 | 45 | 45 |
| Peak Melting Temperature | ExxonMobil Method | ° F. (° C.) | 201 (94) | 169 (76) | 163 (73) |
| Peak Crystal. Temp. | ExxonMobil Method | ° F. (° C.) | 165 (74) | 133 (56) | 120 (49) |

TABLE 7-continued

| Physical Properties[2] | Test Based On | Units (SI) | AT-310 Typical Value | AT-320 Typical Value | AT-325 Typical Value |
|---|---|---|---|---|---|
| Young's Modulus | ASTM ® D-638 | psi (MPa) | 2700 (19) | 1300 (8.6) | |
| Flex Modulus | ASTM ® D-790 | psi (MPa) | 8650 (60) | 2700 (19) | 2000 (14) |
| Vicat Soft. Po 200 g | ExxonMobil Method | ° F. (° C.) | | | |
| 1000 g | ASTM ® D-1525 | | 187 (86) | 150 (66) | |
| | | | 161 (66) | 109 (43) | 104 (40) |
| Tensile Strength[3] | | | | | |
| @ yield | | | 480 (3.3) | | |
| @ break | ASTM ® D-638 | psi (MPA) | 2100 (14) | 1100 (76) | 630 (4.3) |
| Elong.[3] @ break | ASTM ® D-638 | % | 570 | 660 | 725 |
| Instrumented Impact[4] | ASTM ® D-3763 | ft-lb (J) | | | |
| Max Energy/Total | | | | | |
| Energy 23° C. | | | 4.7 (6.4)/11 (15) | 7.7(10)/10(14) 5.0 (6.8)/8.5 | 4.5 (6.1)/7.5 (10) |
| −40° C. | | | 5.4(7.3)/9.4 (13) | (12) | 4.7 (6.4)/4.7 (6.4) |
| Hardness, 15s | | | | | |
| Shore A | ASTM ® D-2240 | — | 90 | 83 | 78 |
| Shore D | | | 41 | 34 | 23 |

[1]Values are typical and should not be interpreted as specifications.
[2]Physical properties were measured on compression molded specimens.
[3]Tensile testing was conducted at a crosshead speed of 2 in/min.
[4]12.5 mm striker, 76 mm anvil span and 200 m/min test speed.

Additional materials may also be added to the compositions of the present invention, including dyes (for example, ULTRAMARINE BLUE™ sold by Whitaker, Clark, and Daniels of South Plainsfield, N.J.) (see U.S. Pat. No. 4,679,795), pigments such as titanium dioxide, zinc oxide, barium sulfate and zinc sulfate; UV absorbers; antioxidants; antistatic agents; and stabilizers. Moreover, the cover compositions of the present invention may also contain softening agents, such as plasticizers, processing aids, etc., and reinforcing materials such as glass fibers and inorganic fillers, as long as the desired properties produced by the golf ball covers of the invention are not impaired.

The cover compositions of the present invention may be produced according to conventional melt blending procedures. Generally, the soft ionomer resins are blended with the hard ionomeric resins (if so desired) in a BANBURY® type mixer, two-roll mill, or extruder prior to molding. The blended composition is then formed into slabs and maintained in such a state until molding is desired. If necessary, further additives such as inorganic fillers, antioxidants, stabilizers, and/or zinc oxide may be added and uniformly mixed before initiation of the molding process.

The golf balls of the present invention can be produced by molding processes currently well known in the golf ball art. Specifically, the golf balls can be produced by injection molding or compression molding the novel cover compositions about wound or solid molded cores to produce a golf ball having a diameter of about 1.680 to about 1.800 inches and weighing about 1.620 ounces. The standards for both the minimum diameter and maximum weight of the balls have been established by the United States Golf Association (USGA).

Although both solid core and wound cores can be utilized in the present invention, as a result their lower cost and superior performance, solid molded cores are preferred over wound cores.

The term "solid cores" as used herein refers not only to one piece cores but also to those cores having a separate solid layer beneath the cover and above the core as in U.S. Pat. No. 4,431,193, and other multi-layer and/or non-wound cores. The cores are produced using methods and materials known in the art.

The core is converted into a golf ball by providing at least one layer of covering material thereon, ranging in thickness from about 0.070 to about 0.130 inches and preferably from about 0.0675 to about 0.1275 inches.

As indicated, the golf balls of the present invention may be produced by forming covers consisting of the compositions of the invention around cores by conventional molding processes known in the art. For example, in compression molding, the cover composition is formed via injection at about 380° F. to about 450° F. into smooth surfaced hemispherical shells which are then positioned around the core in a dimpled golf ball mold and subjected to compression molding at 200–300° F. for 2–10 minutes, followed by cooling at 50–70° F. for 2–10 minutes, to fuse the shells together to form an unitary ball. In addition, the golf balls may be produced by injection molding, wherein the cover composition is injected directly around the core placed in the center of a golf ball mold for a period of time at a mold temperature of from 50° F. to about 100° F. After molding the golf balls produced may undergo various further processing steps such as buffing, painting, and marking.

Golf balls according to the invention preferably have a PGA compression of 10–110. In a particularly preferred form of the invention, the golf balls have a PGA compression of about 40–100. It has been found that excellent results are obtained when the PGA compression of the golf balls is 60–100. The coefficient of restitution of the golf balls of the invention is in the range of 0.770 or greater. Preferably, the C.O.R. of the golf balls is in the range of 0.770–0.830 and most preferably 0.790–0.830.

As is apparent from the above discussions, two principal properties involved in golf ball performance are resilience and PGA compression. The resilience or coefficient of restitution (C.O.R.) of a golf ball is the constant "e," which is the ratio of the relative velocity of an elastic sphere after direct impact to that before impact. As a result, the C.O.R. ("e") can vary from 0 to 1, with 1 being equivalent to a perfectly or completely elastic collision and 0 being equivalent to a perfectly or completely inelastic collision.

The coefficient of restitution is the ratio of the outgoing velocity to the incoming velocity. In the examples of this application, the coefficient of restitution of a golf ball was measured by propelling a ball horizontally at a speed of 125±5 feet per second (fps) against a generally vertical, hard, flat steel plate and measuring the ball's incoming and outgoing velocities electronically. Speeds were measured with a pair of Oehler Mark 55 ballistic screens available from Oehler Research, Inc., Austin, Tex., which provide a timing pulse when an object passes through them. The screens were separated by 36 inches and were located 25.25 inches and 61.25 inches from the rebound wall. The ball speed was measured by timing the pulses from screen 1 to screen 2 on the way into the rebound wall (as the average speed of the ball over 36 inches), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall was solid steel 2.0 inches thick.

The incoming speed should be 125±5 fps but corrected to 125 fps. The correlation between C.O.R. and forward or incoming speed has been studied and a correction has been made over the ±5 fps range so that the C.O.R. is reported as if the ball had an incoming speed of exactly 125.0 fps.

Compression is another important property involved in the performance of a golf ball. The compression of the ball can affect the playability of the ball on striking and the sound or "click" produced. Similarly, compression can affect the "feel" of the ball (i.e., hard or soft responsive feel), particularly in chipping and putting.

Moreover, while compression itself has little bearing on the distance performance of a ball, compression can affect the playability of the ball on striking. The degree of compression of a ball against the club face and the softness of the cover strongly influences the resultant spin rate. Typically, a softer cover will produce a higher spin rate than a harder cover. Additionally, a harder core will produce a higher spin rate than softer core. This is because at impact a hard core serves to compress the cover of the ball against the face of the club to a much greater degree than a soft core thereby resulting in more "grab" of the ball on the clubface and subsequent higher spin rates. In effect the cover is squeezed between the relatively incompressible core and clubhead. When a softer core is used, the cover is under much less compressive stress than when a harder core is used and therefore does not contact the clubface as intimately. This results in lower spin rates. The term "compression" utilized in the golf ball trade generally defines the overall deflection that a golf ball undergoes when subjected to a compressive load. For example, PGA compression indicates the amount of change in golf ball's shape upon striking.

PGA compression relates to a scale of 0 to 200 given to a golf ball. The lower the PGA compression value, the softer the feel of the ball upon striking. In practice, tournament quality balls have compression ratings around 70–110, preferably around 80 to 100.

In determining PGA compression using the 0–200 scale, a standard force is applied to the external surface of the ball. A ball which exhibits no deflection (0.0 inches in deflection) is rated 200 and a ball which deflects 2/10th of an inch (0.2 inches) is rated 0. Every change of 0.001 of an inch in deflection represents a 1 point drop in compression. Consequently, a ball which deflects 0.1 inches (100×0.001 inches) has a PGA compression value of 100 (i.e., 200−100) and a ball which deflects 0.110 inches (110×0.001 inches) has a PGA compression of 90 (i.e., 200−110).

In order to assist in the determination of compression, several devices have been employed by the industry. For example, PGA compression in determined by an apparatus fashioned in the form of a small press with an upper and lower anvil. The upper anvil is at rest against a 200-pound die spring, and the lower anvil is movable through 0.300 inches by means of a crank mechanism. In its open position the gap between the anvils is 1.780 inches allowing a clearance of 0.100 inches for insertion of the ball. As the lower anvil is raised by the crank, it compresses the ball against the upper anvil, such compression occurring during the last 0.200 inches of stroke of the lower anvil, the ball then loading the upper anvil which in turn loads the spring. The equilibrium point of the upper anvil is measured by a dial micrometer if the anvil is deflected by the ball more than 0.100 inches (less deflection is simply regarded as zero compression) and the reading on the micrometer dial is referred to as the compression of the ball. In practice, tournament quality balls have compression ratings around 80 to 100 which means that the upper anvil was deflected a total of 0.120 to 0.100 inches.

An example to determine PGA compression can be shown by utilizing a golf ball compression tester produced by OK Automation, Sinking Spring, Pa. (formerly Atti Engineering Corporation).

Alternative devices have also been employed to determine compression. For example, Applicant also utilizes a modified Riehle Compression Machine originally produced by Riehle Bros. Testing Machine Company, Philadelphia, Pa. to evaluate compression of the various components (i.e., cores, mantle cover balls, finished balls, etc.) of the golf balls. The Riehle compression device determines deformation in thousandths of an inch under a fixed initialized load of 200 pounds. Using such a device, a Riehle compression of 61 corresponds to a deflection under load of 0.061 inches.

Additionally, an approximate relationship between Riehle compression and PGA compression exists for balls of the same size. It has been determined by Applicant that Riehle compression corresponds to PGA compression by the general formula PGA compression=160−Riehle compression. Consequently, 80 Riehle compression corresponds to 80 PGA compression, 70 Riehle corresponds to 90 PGA compression, and 60 PGA compression corresponds to 100 PGA compression. For reporting purposes, Applicant's compression values are usually measured as Riehle compression and converted to PGA compression.

Furthermore, additional compression devices may also be utilized to monitor golf ball compression so long as the correlation to PGA compression is known. These devices have been designed, such as a Whitney Tester or an Instron, to correlate or correspond to PGA compression through a set relationship or formula.

In this application, Shore D hardness of a cover is measured generally in accordance with ASTM® D-2240, except the measurements are made on the curved surface of a molded cover, rather than on a plaque. Furthermore, the Shore D hardness of the cover is measured while the cover remains over the core. When a hardness measurement is made on a dimpled cover, Shore D hardness is measured at a land area of the dimpled cover.

Golf balls according to the invention have a cut resistance in the range of 1–3 on a scale of 1–5. It is preferred that the golf balls of the invention have a cut resistance of 1–2.5 and most preferably 1–2.

The scuff resistance test was conducted in the following manner: a TOP-FLITE® Tour pitching wedge (1994) with box grooves was obtained and was mounted in a Miyamae® driving machine. The club face was oriented for a square hit. The forward/backward tee position was adjusted so that the tee was four inches behind the point in the downswing where the club was vertical. The height of the tee and the toe-heel position of the club relative to the tee were adjusted in order that the center of the impact mark was about ¾ of an inch above the sole and was centered toe to heel across the face. The machine was operated at a clubhead speed of 125 feet per second. Three samples of each ball were tested. Each ball was hit three times. After testing, the balls were rated according to the following table:

| Rating | Type of damage |
|---|---|
| 1 | Little or no damage (groove markings or dents) |
| 2 | Small cuts and/or ripples in cover |
| 3 | Moderate amount of material lifted from ball surface but still attached to ball |
| 4 | Material removed or barely attached |

Cut resistance was measured in accordance with the following procedure: A golf ball was fired at 135 feet per second against the leading edge of a 1994 TOP-FLITE® Tour pitching wedge, wherein the leading edge radius is 1/32 inch, the loft angle is 51 degrees, the sole radius is 2.5 inches, and the bounce angle is 7 degrees.

The cut resistance of the balls tested herein was evaluated on a rating of 1–5. A rating of 5 represents a cut that extends completely through the cover to the core; a rating of 4 represents a cut that does not extend completely through the cover but that does break the surface; a rating of 3 does not break the surface of the cover but does leave a permanent dent; a rating of 2 leaves only a slight crease which is permanent but not as severe as 3; and a rating of 1 represents virtually no visible indentation or damage of any sort.

Figure 2:
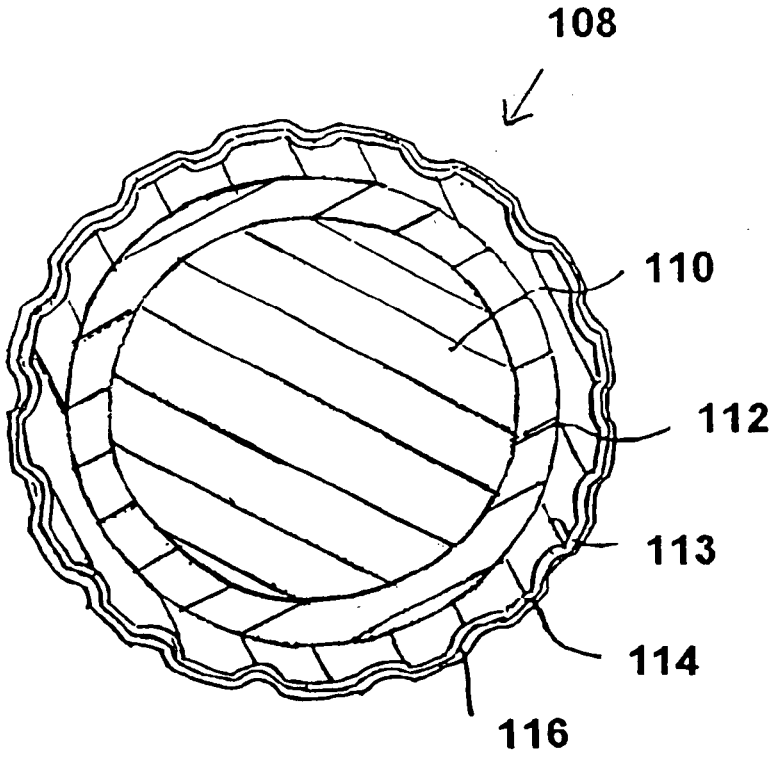
FIG. 2 illustrates a second embodiment of a golf ball according to the present invention.

FIG. 2 shows a further preferred multi-layered embodiment of the invention. The golf ball, which is designated as 108, has a central core 110, which is a solid, or is formed from any other suitable type of core composition. An ionomeric inner cover layer 112 surrounds the core 110. An ionomeric outer cover layer 113 surrounds the inner cover layer 112. A thin primer coat 114 is applied to the outer surface of cover 113. A thin top coat 116 surrounds the primer coat 114. The thicknesses of primer coat 114 and top coat 116 are exaggerated for illustrative purposes.

In the embodiment shown in FIG. 2, the inner and/or outer ionomeric cover layer contains the specific high melt ionomeric blends of the present invention. Preferably, the high melt ionomer blend is present in the outer ionomeric cover layer. However, the present invention is not limited to such combinations as were particularly discussed above.

Having generally described the invention, the following examples are included for purposes of illustration so that the invention may be more readily understood and are in no way intended to limit the scope of the invention unless otherwise specifically indicated.

EXAMPLES

Example 1

Using the ingredients tabled below, golf ball cores having a finished diameter of about 1.540 to about 1.545 inches were produced by compression molding and subsequent removal of a surface layer by grinding. Each core was formulated using 100 parts elastomer (rubber). In the formulations, the amounts of remaining ingredients are expressed in parts by weight, and the weight, degrees of coefficient of restitution and compression (Riehle and/or PGA) achieved are set forth below. The data for these examples are the averages for twelve cores which were produced for each example. The properties of the molded cores produced from each formulation were measured according to the parameters set forth above and/or noted below.

The core formulations in TABLE 8 below were prepared according to the methods set forth above.

TABLE 8

Golf Ball Core Formulation

| MATERIAL | WEIGHT | VOLUME | 100% |
|---|---|---|---|
| CARIFLEX ® 1220 (high-cis polybutadiene) | 70 | 76.92 | 37.93 |
| TAKTENE ® 220 (high-cis polybutadiene) | 30 | 32.97 | 16.25 |
| Zinc Oxide | 31.5 | 5.67 | 17.07 |
| T.G. Core Regrind | 16 | 13.56 | 8.67 |
| Zinc Stearate | 16 | 14.68 | 8.67 |
| Zinc Diacrylate | 20 | 7.69 | 10.84 |
| QD 0075 Green Masterbatch | 0.15 | 0.10 | .01 |
| 29/40 OR 231XL Peroxide | 0.90 | 0.64 | .49 |
| TOTAL | 184.55 | 153.13 | 100.0 |

| Core Data | Results |
|---|---|
| Size (in.) | 1.545 |
| Weight (g.) | 36.7 |
| PGA Compression | 65 |
| C.O.R. (X 1000) | 790 |
| Shore D hardness | 49 |

The cores were covered with relatively soft, 0.070 inch thick covers formed from several different ionomeric compositions containing various high melt ionomers. Specifically, a dozen golf balls (diameter 1.680 inches) were produced for each formulation as presented in TABLE 9 below.

TABLE 9

COVER FORMULATIONS

| MATERIAL | 1 | 2 | 3 | 4 | 5 | 6 |
|---|---|---|---|---|---|---|
| TGMB[1] | 285 | 285 | 285 | 285 | 287 | 287 |
| IOTEK ® 7510 | 1200 | 1200 | 1200 | 1200 | 1710 | 1710 |
| IOTEK ® 7520 | 1200 | 1200 | 1200 | 1200 | | |
| SURLYN ® AD8549 | 315 | | | | | 1003 |
| SURLYN ® AD8660 | | 315 | | | | |
| SURLYN ® AD8940 | | | 315 | | | |
| IOTEK ® 8000 | | | | 315 | 1003 | |

[1]TGMB = Top Grade Masterbatch which consists of 100 parts IOTEK ® 7030, 31.3 parts UNITANE ™ 0110, 0.605 ULTRAMARINE BLUE ™, 0.34 EASTOBRITE ® O.B., and 0.05 SANTONOX ® R.

The modified balls were then subject to heat distortion evaluation. Specifically, the unfinished balls were heat treated at various temperatures for several different time frames. Heat distortion of the covers was observed visually.

Controls were used and the experimental formulations were compared to the controls after all balls were subject to the same thermal history. The maximum temperature selected for testing was 85° C. Distortion effects were also studied at lower temperatures.

In performing the heat distortion analysis, one or more control specimens was placed on a tray with one or more experimental specimens. The tray was then placed in an oven set to the specified temperature. At some time interval (for example, 20 minutes for 85° C.; 40–60 minutes for 55° C., etc.) the balls were removed and compared visually. If necessary (for example, to better distinguish the behavior of one formulation versus another), the balls were replaced in the oven and checked again after another time interval. The testing continued until the balls could be ranked relative to one another. The results are reported below.

A. 40 Minutes @ 85° C.

Golf balls covered with Formulations Nos. 1–3 maintained their dimple patterns in comparison to the TOP-FLITE® Strata™ control (Formulation No. 4). In addition, the dimple retention of golf ball Formulation No. 1 was better than that of golf ball Formulation Nos. 2–3.

B. 16 Hours @ 88° C.

Golf balls covered with Formulation No. 5 (i.e. the Z-Balata control) exhibited a washed out dimple pattern. In turn, golf balls covered with Formulation No. 6 containing SURLYN® 8549 retained the dimple pattern.

C. 65 Min. @ 88° C.

Utilizing visual inspection, the balls were rated for dimple retention as follows:

Formulation No. 1 (w/SURLYN® 8549)>Formulation No. 2 (w/SURLYN® 8660)>Formulation No. 3 (w/SURLYN® 8940)>Formulation No. 4 (w/IOTEK® 8000, TOP-FLITE® Strata™ control)

D. 2.5 Hours @ 77° C.

Utilizing visual inspection, the balls were rated for dimple retention with the results the same as C above (Formulation No. 1>Formulation No. 2>Formulation No. 3>Formulation No. 4).

E. 65 Min @ 86° C.

Utilizing visual inspection, the balls were rated for dimple retention with the same results as C and D above.

F. 45 Min @ 86° C.

Utilizing visual inspection, the balls were rated for dimple retention with the same results as C, D and E above.

The above data indicated that soft ionomer cover formulations containing SURLYN® 8549 exhibited the best heat resistance in comparison with other soft ionomer cover formulations utilizing other high melt ionomers.

Example 2

A number of multi-layer golf balls were produced for dimensional stability testing at elevated temperatures. The following mantle and cover stock formulations were produced and molded over the cores utilized above.

| Production Mantle Formulations | Heat Resistant Mantle Formulation | |
|---|---|---|
| 50 parts IOTEK ® 1003 | IOTEK ® 1003 | 2500 g |
| 50 parts IOTEK ® 1002 | SURLYN ® 8549 | 2800 g |
| 100 parts TOTAL | TOTAL: | 5000 g |
| **Production Cover Formulation** | **Heat Resistant Cover Formulation** | |
| 41 parts IOTEK ® 7510 | IOTEK ® 7510 | 2000 g |
| 41 parts IOTEK ® 7520 | IOTEK ® 7520 | 2000 g |
| 8.5 parts IOTEK ® 8000 | SURLYN ® 8549 | 252 g |
| 9.5 parts TOMB | Top Grade | 475 |
| 100 parts TOTAL | Master Batch[2] | |
| | TOTAL: | 5000 g |

[2]Top Grade Master Batch consists of IOTEK ® 7030 MB.

Four types of golf balls were then produced (one dozen of each) using the above formulations. These are as follows:

Production Mantle (Prod)/Production (Prod) Cover (Control)
Production (Prod) Mantle/Heat Resistant (Exp) Cover
Heat Resistant (Exp) Mantle/Production (Prod) Cover
Heat Resistant (Exp) Mantle/Heat Resistant (Exp) Cover The unfinished balls were then evaluated as shown in TABLE 10.

TABLE 10

| | | 10 | 11 | 12 | 13 |
|---|---|---|---|---|---|
| Mantle | | exp | exp | prod | prod |
| Cover | | prod | exp | prod | exp |
| As-molded balls | | | | | |
| Comp (Whitney) | | 0.0820 | 0.0818 | 0.0820 | 0.0820 |
| | std dev | 0.0018 | 0.0016 | 0.0010 | 0.0014 |
| Comp (Riehle) | | 81 | 78 | 81 | 82 |
| | | 82 | 79 | 82 | 81 |
| | | 82 | 81 | 82 | 82 |
| | | 80 | 86 | 80 | 78 |
| | | 84 | 84 | 83 | 82 |
| | | 83 | 80 | 82 | 80 |
| | | 80 | 80 | 79 | 81 |
| | | 81 | 78 | 82 | 84 |
| | | 81 | 84 | 86 | 85 |
| | | 82 | 81 | 84 | 82 |
| | | 84 | 82 | 81 | 84 |
| | | 81 | 80 | 78 | 79 |

TABLE 10-continued

| | | 10 | 11 | 12 | 13 |
|---|---|---|---|---|---|
| | average | 81.8 | 81.1 | 81.7 | 81.7 |
| | Std dev | 1.4 | 2.5 | 2.1 | 2.1 |
| C.O.R. | | 0.7703 | 0.7713 | 0.7736 | 0.7727 |
| | std dev | 0.0018 | 0.0028 | 0.0013 | 0.0017 |
| (300 blows) | | 1 @ 47-jamming; 1 @ 300 cutting | jammed causing cut; 1 break at 297 | no failures but jamming due to cutting | no failures |
| Thermal Testing 85° C. for 16 hrs | | pumpkin, but dimple pattern a bit more recognizable than Formulation 10 | best dimple retention | pumpkin | good dimple retention |

Additionally, the above golf balls were then finished (F) with primer and top-coat and the properties of the finished balls were evaluated as disclosed in TABLE 11.

TABLE 11

| Comp (W) | 10 (F) | 11 (F) | 12 (F) | 13 (F) |
|---|---|---|---|---|
| Mantle Cover | exp prod | exp exp | prod prod | prod exp |
| Size (inches) | 1.684 | 1.683 | 1.683 | 1.683 |
| Weight (g) | 44.92 | 44.9 | 44.95 | 44.96 |
| Comp. (W) | 0.08 | 0.079 | 0.08 | 0.08 |
| C.O.R. | 0.7702 | 0.7707 | 0.7727 | 0.7727 |
| Cold Crack | 1 br @ 4<br>1 br @ 5 | no breaks | 2 br @ 4<br>1 br @ 5 | 1 br @ 2<br>1 br @ 3 |

The above results indicate that the heat resistant mantles and covers of the present invention produced excellent melt resistance after severe high temperature exposure, i.e. 16 hours of thermal testing.

Example 3

The below indicated cover formulations were molded over the cores of Example 1 to provide the results as shown in TABLE 12.

TABLE 12

| | 20 | 21 | 22 | 23 |
|---|---|---|---|---|
| Materials | | | | |
| IOTEK ® 7510 | 41 | 41 | 41 | 41 |
| IOTEK ® 7520 | 41 | 49.5 | 49.5 | 41 |
| IOTEK ® 8000 | 8.5 | | | |
| SURLYN ® 8549 | | | | 8.5 |

TABLE 12-continued

| | 20 | 21 | 22 | 23 |
|---|---|---|---|---|
| IOTEK ® 7030 MB[3] | 9.5 | 9.5 | | |
| SURLYN ® 8549 MB[4] | | | 9.5 | 9.5 |
| Static Data | | | | |
| size | 1.686 | 1.683 | 1.683 | 1.683 |
| weight | 45.5 | 45.4 | 45.3 | 45.3 |
| comp | 81/82 | 80/81 | 80/80 | 82 |
| C.O.R. | .776 | .775 | .778 | .777 |
| Shore C/D | 75/47 | 72/46 | 73/46–47 | 76/49 |
| Finished Barrel (300 Blow) | no failures | no failures | no failures | no failures |
| Finished Cold Crack | | | | |
| Heat Results | 3rd | 4th | 2nd | 1st |

[3]IOTEK ® 7030 MB = 100 parts IOTEK ® 7030, 31.3 parts UNITANE ™ 0110, 0.605 parts ULTRAMARINE BLUE ™ , 0.34 EASTOBRITE ® O.B., and 0.05 SANTONOX ® R.
[4]SURLYN ® 8549 MB = 100 parts SURLYN ® 8549, 31.3 parts UNITANE ™ 0–100, 0.605 ULTRAMARINE BLUE ™ , 0.34 EASTOBRITE ® O.B., and 0.05 SANTONOX ® R.

The data indicates that the golf ball covered with SURLYN® 8549 exhibited the best dimple retention and heat resistance.

Example 4

Five different golf balls were prepared with the same control cores and the cover formulations disclosed in TABLE 13 below (values in parentheses denote parts by weight).

TABLE 13

| | 21 | 22 | 23 | 24 | 25 |
|---|---|---|---|---|---|
| IOTEK ® 8000 | 340 (8.5) | 340 (8.5) | — | — | — |
| IOTEK ® 7510 | 1640 (41) | — | — | 1640 (41) | — |
| IOTEK ® 7520 | 1640 (41) | 1640 (41) | 1980 (49.5) | 1640 (41) | 1880 (47) |
| SURLYN ® 8269 | — | 1640 (41) | 1640 (41) | — | 1400 (35) |

TABLE 13-continued

| | 21 | 22 | 23 | 24 | 25 |
|---|---|---|---|---|---|
| SURLYN ® 7940 | — | — | — | 340 (8.5) | 340 (8.5) |
| Masterbatch[1] | 380 (9.5) | 380 (9.5) | 380 (9.5) | 380 (9.5) | 380 (9.5) |

[1]The Masterbatch includes the following formulation:
100 parts IOTEK ® 7030
31.3 parts UNITANE ™ 0110
0.605 parts ULTRAMARINE BLUE ™
0.34 parts EASTOBRITE ®
0.05 parts SANTONOX ® R The golf balls having the above-identified formulations were tested and found to exhibit the properties as shown in TABLE 14.

TABLE 14

| | 21 | 22 | 23 | 24 | 25 |
|---|---|---|---|---|---|
| Melt Index (g/10°) | 2.51 | 1.88 | 1.93 | 2.78 | 2.06 |
| Shore D/C | 47/72 | 51/76 | 50/73 | 48/72 | 48/75 |
| Guillotine | 2–2.5 (1st) | 2–2.5 (3rd) | 2–2.5 (1st) | 2–2.5 (5th) | 2–2.5 (4th) |
| Weight (g) | 45.4 | 45.3 | 45.3 | 45.4 | 45.3 |
| Size (in.) | 1.682 | 1.681 | 1.681 | 1.682 | 1.682 |
| Compression | 77/75 | 77/76 | 77/75 | 77/76 | 75/74 |
| C.O.R. | 0.782 | 0.783 | 0.781 | 0.781 | 0.782 |

As shown in TABLE 14 above, formulations 21–25 exhibit very similar properties.

The golf balls with the above formulations underwent two different melt tests. The first melt test included placing each ball in an oven at 167° F. for four (4) hours. The second melt test included placing each ball in an oven at 167° F. for twenty-four (24) hours. Each golf ball was visually inspected for changes or deformities due to the elevated temperature. The golf balls for both the four hour and twenty-four hour melt test ranked from best to worst in the following order:

| Four Hours @ 167° F. | | Twenty-Four Hours @ 167° F. | |
|---|---|---|---|
| Best | 25 | Best | 25 |
| | 24 | | 24 |
| | 21 | | 21 |
| | 22 | | 22 |
| Worst | 23 | Worst | 23 |

The two melt tests show that formulations 24 and 25 maintained their respective composition at a relatively high temperature better than formulation 21–23.

Example 5

Golf ball covers were formed with the formulations show in TABLE 15 (values in parentheses denote parts by weight).

TABLE 15

| | 26 | 27 | 28 | 29 | 30 | 31 | 32 |
|---|---|---|---|---|---|---|---|
| IOTEK ® 7510 | 1640 (41) | 3620 (90.5) | 1810 (45.25) | 1600 (40) | 1600 (40) | 1600 (40) | 1600 (40) |
| IOTEK ® 7520 | 1640 (41) | — | 1810 (45.25) | 1600 (40) | 1600 (40) | 1600 (40) | 1600(40) |
| IOTEK ® 8000 | 340 (8.5) | — | — | — | — | — | — |
| SURLYN ® 8020 | — | — | — | 420 (10.5) | — | — | — |
| SURLYN ® 9020 | — | — | — | — | 420 (10.5) | — | — |
| SURLYN ® 9450 | — | — | — | — | — | 420 (10.5) | — |

TABLE 15-continued

| | 26 | 27 | 28 | 29 | 30 | 31 | 32 |
|---|---|---|---|---|---|---|---|
| SURLYN ® 8528 | — | — | — | — | — | — | 420 (10.5) |
| Master-batch[1] | 380 (9.5) | 380 (9.5) | 380 (9.5) | 380 (9.5) | 380 (9.5) | 380 (9.5) | 380 (9.5) |

[1]The Masterbatch includes the following formulation:
100 parts IOTEK ® 7030
31.3 parts UNITANE ™ 0110
0.605 parts ULTRAMARINE BLUE ™
0.34 parts EASTOBRITE ®
0.05 parts SANTONOX ® R The above cover formulations were molded over control cores and exhibited the properties shown in TABLE 16 below.

TABLE 16

| Formulation No. | Compression (Riehle) | C.O.R. |
|---|---|---|
| 26 | 74 | 0.780 |
| 27 | 73 | 0.781 |
| 28 | 75 | 0.780 |
| 29 | 74 | 0.779 |
| 30 | 74 | 0.781 |
| 31 | 75 | 0.782 |
| 32 | 75 | 0.780 |

Formulation numbers 27 and 28 were merely coated formulations having one or a blend of soft ionomers without a hard ionomer. As shown in TABLE 16, formulation nos. 26–32 exhibited similar compression and C.O.R. values. Due to the addition of a hard ionomer, formulation nos. 26 and 29–32 exhibited an overall increased Vicat softening temperature compared to formulation numbers 27 and 28, thereby improving overall melt resistance at elevated temperatures while otherwise maintaining similar properties.

Example 6

Golf ball covers were formed with the formulations shown in TABLE 17.

TABLE 17

| Material | Vicat Softening Point (° C.) | Percent Acid | 33 | 34 | 35 | 36 | 37 | 38 | 39 |
|---|---|---|---|---|---|---|---|---|---|
| IOTEK ® 7510 | 40 | 6 | 623 | 630 | 615 | 615 | 623 | 623 | 623 |
| IOTEK ® 7520 | 40 | 6 | 623 | 630 | 615 | 615 | 623 | 623 | 623 |
| IOTEK ® 8000 | 54 | 15 | 128 | 217.5 | — | — | 128 | — | — |
| IOTEK ® 7030 | 60 | 15 | 105 | — | — | — | 105 | — | — |
| IOTEK ® 3110 | 75 | 9 | — | — | 248 | — | — | — | — |
| IOTEK ® 4200 | 72 | 11 | — | — | — | 248 | — | — | — |
| SURLYN ® 9450 | 79 | | — | — | — | — | — | — | 233 |
| SURLYN ® 8528 | 73 | | — | — | — | — | — | 233 | — |
| $TiO_2$ | — | — | 37 | 37 | 37 | 37 | 37 | 37 | 37 |

In formulation nos. 35 and 36, higher levels of IOTEK® 3110 and 4200 were used because IOTEK® 3110 and 4200 are softer than IOTEK® 8000 or 7030. The formulations were mixed in a BANBURY® mixer and milled to be chopped, dried and molded. Also, formulation no. 33 was designed not only to test melt resistance, but also to improve scuff resistance over the other formulations as the IOTEK® 7030 used to form formulation number 33 is a relatively hard ionomer.

Formulation nos. 33–39 were molded over control cores to form golf balls and were melt tested at 160° F. and 170° F. for equal amounts of time. TABLE 18 below shows the results of the melt test.

TABLE 18

| | Melt Test | |
|---|---|---|
| Formulation | 160° F. | 170° F. |
| 33 | Seventh | Sixth |
| 34 | Sixth | Seventh |
| 35 | Third | Second |
| 36 | Fourth | Fourth |
| 37 | Fifth | Fifth |
| 38 | Second | Third |
| 39 | First | First |

Based upon the melt test at 160° F. and 170° F., formulations nos. 35, 38, and 39 exhibited the best melt resistance characteristics.

Example 7

Golf ball cover formulation no. 40 was formed with the ingredients shown in TABLE 19.

TABLE 19

| Ingredients | Formulation No. 40 |
|---|---|
| IOTEK ® 7510 | 788 |
| IOTEK ® 7520 | — |
| IOTEK ® 8000 | 570 |
| IOTEK ® 7030 | 105 |
| UNITANE ™ 0110 | 37 |

Golf ball formulation no. 40, which has a blend of soft (IOTEK® 7510) and hard (IOTEK® 800 and IOTEK® 7030) ionomers, exhibited improved melt resistance at an elevated temperature over cover formulations having only soft ionomers such as formulation nos. 27 and 28 disclosed in Example 5.

Example 8

Golf ball covers were formed having the formulations disclosed in TABLE 20 (calculated in parts by weight).

TABLE 20

| Materials | Melt Index | 41 | 42 | 43 | 44 | 45 | 46 |
|---|---|---|---|---|---|---|---|
| IOTEK ® 7510 | 0.8 | 41 | 70 | 45.3 | 40.3 | 68 | — |
| IOTEK ® 7520 | 2 | 41 | — | 22.7 | 40.3 | 22.6 | 45.3 |
| IOTEK ® 8000 | 0.8 | 8.5 | — | — | — | — | — |
| AT 310 | 6 | — | — | 22.8 | — | — | — |
| AT 320 | 5 | — | 20.5 | — | — | — | — |
| SURLYN ® 8940 | 2.8 | — | — | — | 9.9 | — | — |
| ATX 320 (LiOH) | NA | — | — | — | — | — | 45.2 |
| Master-batch | Na | 9.5 | 9.5 | 9.5 | 9.5 | 9.5 | 9.5 |

Golf balls were formed using the above formulations with the same control cores. The golf balls with the above-identified cover formulations exhibited the following properties:

TABLE 21

| | 41 | 42 | 43 | 44 | 45 | 46 |
|---|---|---|---|---|---|---|
| Melt Index | 1.72 | 0.74 | 1.44 | 2.17 | 0.56 | 0.83 |
| Hardness (Shore D) | 47 | | 47 | 47 | | |
| Guillotine | Pass | | Pass | Pass | | |

Formulation nos. 41, 43, and 44 exhibited a desired softness while maintaining durability in passing the Guillotine test.

As will be apparent to persons skilled in the art, various modifications and adaptations of the structure above described will become readily apparent without departure from the spirit and scope of the invention, the scope of which is defined in the appended claims.

What is claimed is:

1. A golf ball comprising:

a core; and a cover disposed about said core, said cover comprising less than about 20 parts by weight of at least one hard ionomer copolymer exhibiting a Vicat softening temperature of greater than about 74° C. and at least about 80 parts by weight of at least one soft ionomer.

2. The golf ball according to claim 1, wherein said at least one soft ionomer is an ionomer terpolymer.

3. The golf ball according to claim 1, wherein said at least one soft ionomer is a terpolymer comprising an ethylene-methyl acrylate-acrylic acid.

4. The golf ball according to claim 3, wherein said cover further comprises a second soft ionomer, said second soft ionomer is a terpolymer formed from an ethylene-methacrylic acid-acid butyl acrylate.

5. The golf ball according to claim 1, wherein said at least one soft ionomer exhibits a Vicat softening temperature of less than 50° C.

6. The golf ball according to claim 1, wherein said at least one hard ionomer copolymer is formed from an ethylene-methacrylic acid copolymer.

7. The golf ball according to claim 1, wherein said at least one hard ionomer copolymer is formed from an ethylene-acrylic acid copolymer.

8. The golf ball according to claim 1, wherein said at least one hard ionomer exhibits a Vicat softening temperature of at least 80° C.

9. The golf ball according to claim 8, wherein said at least one hard ionomer exhibits a Vicat softening temperature of at least 84° C.

10. A golf ball comprising:

a core; and a cover disposed about said core, said cover comprising less than about 20 parts by weight of at least one hard ionomer copolymer exhibiting a Vicat softening temperature of at least about 74° C., and at least about 80 parts by weight of a blend of two soft ionomer terpolymers.

11. The golf ball of claim 10, wherein said at least one hard ionomer copolymer is an ethylene-acrylic acid copolymer.

12. The golf ball according to claim 10, wherein said at least one hard ionomer copolymer is an ethylene-methacrylic acid copolymer.

13. The golf ball according to claim 10, wherein at least one of said blend of two soft ionomer terpolymers is an ethylene-methyl acrylate-acrylic acid terpolymer.

14. The golf ball according to claim 11 wherein at least one of said blend of two soft ionomer terpolymers is an ethylene-methacrylic acid-butyl acrylate terpolymer.

15. A golf ball comprising:

a core; and a cover disposed about said core, said cover comprising from about 1 to about 50 parts by weight of at least one non-ionomeric terpolymer exhibiting a Vicat softening temperature of at least 74° C. and from about 99 to about 50 parts by weight of at least one soft ionomer terpolymer.

16. The golf ball according to claim 15, wherein said non-ionomeric terpolymer is a polyethylene-acrylic methyl acrylate-acrylic acid terpolymer.

17. The golf ball according to claim 15, wherein said non-ionomeric terpolymer exhibits a Vicat softening temperature of at least 80° C.

18. The golf ball according to claim 15, wherein said cover further comprises a second soft ionomer terpolymer, said soft ionomer terpolymers thereby forming a blend of two soft ionomer terpolymers.

* * * * *